US007220155B2

(12) United States Patent
Korenjak et al.

(10) Patent No.: US 7,220,155 B2
(45) **Date of Patent: *May 22, 2007**

(54) INTEGRATED ENGINE-JET PUMP DRIVE UNIT FOR MARINE APPLICATION

(75) Inventors: Norbert Korenjak, Stadl-Paura (AT); Heinz Kuzel, Pennewag (AT)

(73) Assignee: BRP-Rotax GmbH & Co. KG, Gunskirchen (AU)

( * ) Notice: Subject to any disclaimer, the term of this patent is extended or adjusted under 35 U.S.C. 154(b) by 0 days.
This patent is subject to a terminal disclaimer.

(21) Appl. No.: 11/423,857

(22) Filed: Jun. 13, 2006

(65) Prior Publication Data

US 2006/0217010 A1 Sep. 28, 2006

Related U.S. Application Data

(63) Continuation of application No. 10/773,407, filed on Feb. 9, 2004, now Pat. No. 7,070,467.

(60) Provisional application No. 60/445,461, filed on Feb. 7, 2003.

(51) Int. Cl.
*B63H 11/00* (2006.01)

(52) U.S. Cl. ..... 440/38

(58) Field of Classification Search ..... 440/38
See application file for complete search history.

(56) References Cited

U.S. PATENT DOCUMENTS

| | | | | |
|---|---|---|---|---|
| 5,460,553 | A | 10/1995 | Craig | |
| 6,406,339 | B1 | 6/2002 | Sills | |
| 6,544,085 | B1 * | 4/2003 | Menard et al. | 440/88 C |
| 6,568,376 | B2 | 5/2003 | Sonnleitner | |
| 6,675,730 | B2 | 1/2004 | Simard | |
| 7,070,467 | B2 * | 7/2006 | Korenjak et al. | 440/38 |

FOREIGN PATENT DOCUMENTS

WO 0112498 A2 2/2001

* cited by examiner

*Primary Examiner*—Stephen Avila
(74) *Attorney, Agent, or Firm*—Osler, Hoskin & Harcourt LLP

(57) ABSTRACT

A watercraft includes a shell, a ride plate, an internal combustion engine, and a jet pump. The shell defines a tunnel that extends forwardly from the transom and is defined laterally by the shell. The tunnel is open at its bottom The ride plate mounts to the shell under the tunnel. The engine and jet pump are supported by the ride plate and disposed in the tunnel. The engine drives the jet pump. The engine is cooled by water that continuously flows past the ride plate. The engine, jet pump, and ride plate are installed from below or the behind the shell.

11 Claims, 4 Drawing Sheets

INTEGRATED ENGINE-JET PUMP DRIVE UNIT FOR MARINE APPLICATION

CROSS REFERENCE TO RELATED APPLICATION

The present application is a continuation if U.S. application Ser. No. 10/773,407, titled "TNTEGRATED ENGINE-JET PUMP DRIVE UNIT FOR MARINE APPLICATION", filed Feb. 9, 2004, now issued as U.S. Pat. No. 7,070,467. Through the '407 application, this application claims priority to U.S. Provisional Patent Application No. 60/445,461, filed on Feb. 7, 2003. Both of these applications are incorporated herein by reference in their entirety.

BACKGROUND OF THE INVENTION

1. Field of the Invention

The present invention relates to a propulsion system for watercraft, in particular for leisure craft and personal watercraft that have jet propulsion units, with an internal combustion engine that powers the jet propulsion system, the engine and the jet propulsion system being designed for inboard operation.

2. Description of Related Art

Personal watercraft are typically constructed by attaching a deck shell to a hull shell to form an engine compartment therebetween. The propulsion systems for these personal watercraft normally include an internal combustion engine disposed in the engine compartment, and a jet propulsion unit in the form of an impeller assembly positioned in a tunnel open to the underside and the stern of the hull. Because of the compact size of personal watercraft, limited space is available within the shell formed by the deck and hull.

One of the important advantages of a jet propulsion system for a watercraft is that the jet propulsion system can be used even in shallow water, where a conventional propeller-powered system can not be used. In addition, the danger of injuries caused by the propeller is reduced if the watercraft collides with either a person or animal.

Known inboard jet propulsion systems (for example, Mercruiser®/Castoldi Jet) are of a considerable overall length and entail significant production costs, because the jet propulsion system and the engine are independent structural units that are connected to one another through a clutch so as to transfer a driving force from the engine to the jet propulsion system. Accordingly, the jet propulsion system and the engine must each mount to the hull separately. The jet propulsion system is usually installed at the bottom of the transom in such a way that it draws water in through the bottom of the watercraft, pressurizes it in a pump unit, and then ejects it through jets in the transom in a direction opposite to the desired direction of movement, so as to generate the required propulsive force. The jets used to change the direction in which the watercraft moves usually pivot horizontally. In known jet-powered watercraft, the engines for the jet propulsion systems are accommodated in their own compartments located centrally in the watercraft. Although this results in a significant reduction of the amount of noise that is emitted, the engine runs hot and must be cooled, which can result in additional expense. Heat also builds up in the dedicated engine compartment. This not only thermally overstresses the engine, but also negatively affects the engine's power output. The engine is constantly aspirating air that has been preheated by the heat radiated from the engine. In addition, the exhaust system has to be double-walled (i.e., water cooled) to minimize radiated heat and prevent thermal overstressing of the hull, which is usually plastic or fiberglass.

To avoid excessive loss of stowage space available in the watercraft caused by the propulsion unit, and to be able to transfer the propulsion unit rapidly and simply from one watercraft to another, WO 01/12498 A2 discloses a propulsion unit comprising an internal combustion engine and a jet propulsion unit in the form of an outboard propulsion unit. The outboard jet propulsion unit is removably mounted to the transom. This outboard jet propulsion unit consists of a housing that is protected against the ingress of water, within which there is a platform on which the engine is mounted on rubber mounting blocks. The jet propulsion unit is similarly mounted within this housing, but beneath the platform, so that it is located completely below the waterline. The engine, which is mounted above the platform, does not come into contact with the water. The jet propulsion unit and the engine are connected to one another by a belt drive, so that the engine's power is transferred to the jet propulsion unit. The fuel tank is arranged in the hull. An additional tank can be provided in the outboard motor, and this is supplied with fuel by a fuel pump, from the main tank that is arranged in the watercraft. One disadvantage in such an arrangement is that the watercraft is made longer. Moreover, the watercraft's maneuverability is also degraded because of the greater moment of inertia that is generated thereby. Additional noise attenuating measures are also required for the propulsion unit, which is enclosed only by the thin, splash-protected cover. Furthermore, powerful outboard motors are very large and because of this are very heavy, and this extra weight is mounted on the transom so that the personal watercraft becomes stern heavy.

SUMMARY OF THE INVENTION

It is therefore one aspect of one or more embodiments of the present invention to provide a propulsion system for a watercraft of the type described heretofore in as compact a manner as possible.

It is another aspect of one or more embodiments of the present invention to provide the best possible cooling for a watercraft engine as economically as possible.

It is another aspect of one or more embodiments of the present invention to provide a watercraft with an inboard engine that is as accessible as possible for maintenance operations.

It is another aspect of one or more embodiments of the present invention to provide a watercraft with an inboard engine that can be transferred rapidly and simply from one watercraft to another.

It is another aspect of one or more embodiments of the present invention to provide a power unit for a jet-propelled watercraft that is particularly quiet.

It is another aspect of one or more embodiments of the present invention to provide a combined engine and jet pump for a watercraft.

Another aspect of one or more embodiments of the present invention provides a watercraft that includes a shell with a transom. The shell defines a tunnel that extends forwardly from the transom. The tunnel is defined laterally by the shell and has at least an open bottom and rear. A ride plate mounts to the shell at the bottom of the tunnel. An internal combustion engine is supported by the ride plate and disposed in the tunnel. A jet pump operatively connects to the internal combustion engine. The jet pump is supported by the ride plate and disposed in the tunnel.

According to a further aspect of one or more embodiments of this invention, the shell defines a top of the tunnel. The engine and jet pump may be installed in the watercraft from below or from the rear of the watercraft. The ride plate preferably forms a continuous surface with an underwater portion of the shell. The ride plate is preferably flexibly mounted to the shell.

According to a further aspect of one or more embodiments of this invention, the tunnel is sealed off from an interior of the shell.

The watercraft may also include a battery, engine electronics, an airbox, and/or a fuel tank disposed in the shell. Each of these operatively connect to the engine.

The watercraft may also include gearing and a clutch operatively disposed between the engine and the jet pump.

The engine may have an engine oil pan mounted to the ride plate. The engine oil pan may be integrally formed with the ride plate.

The engine may be inclined about its longitudinal axis such that the engine is disposed at an angle with respect to a vertical axis. The engine may be disposed above the jet pump. The engine includes a crankshaft. The jet pump includes a driveshaft. The driveshaft and crankshaft occupy overlapping longitudinal positions on the watercraft. The crankshaft and driveshaft may be parallel to each other. The engine's crankcase, the ride plate, and/or the intake area of the jet pump may be at least partially integrally formed with each other.

Additional and/or alternative advantages and salient features of the invention will become apparent from the following detailed description, which, taken in conjunction with the annexed drawings, disclose preferred embodiments of the invention.

BRIEF DESCRIPTION OF THE DRAWINGS

The invention will now be described in conjunction with the following drawings in which like reference numerals designate like elements and wherein.

DETAILED DESCRIPTION OF PREFERRED EMBODIMENTS

Figure 1:
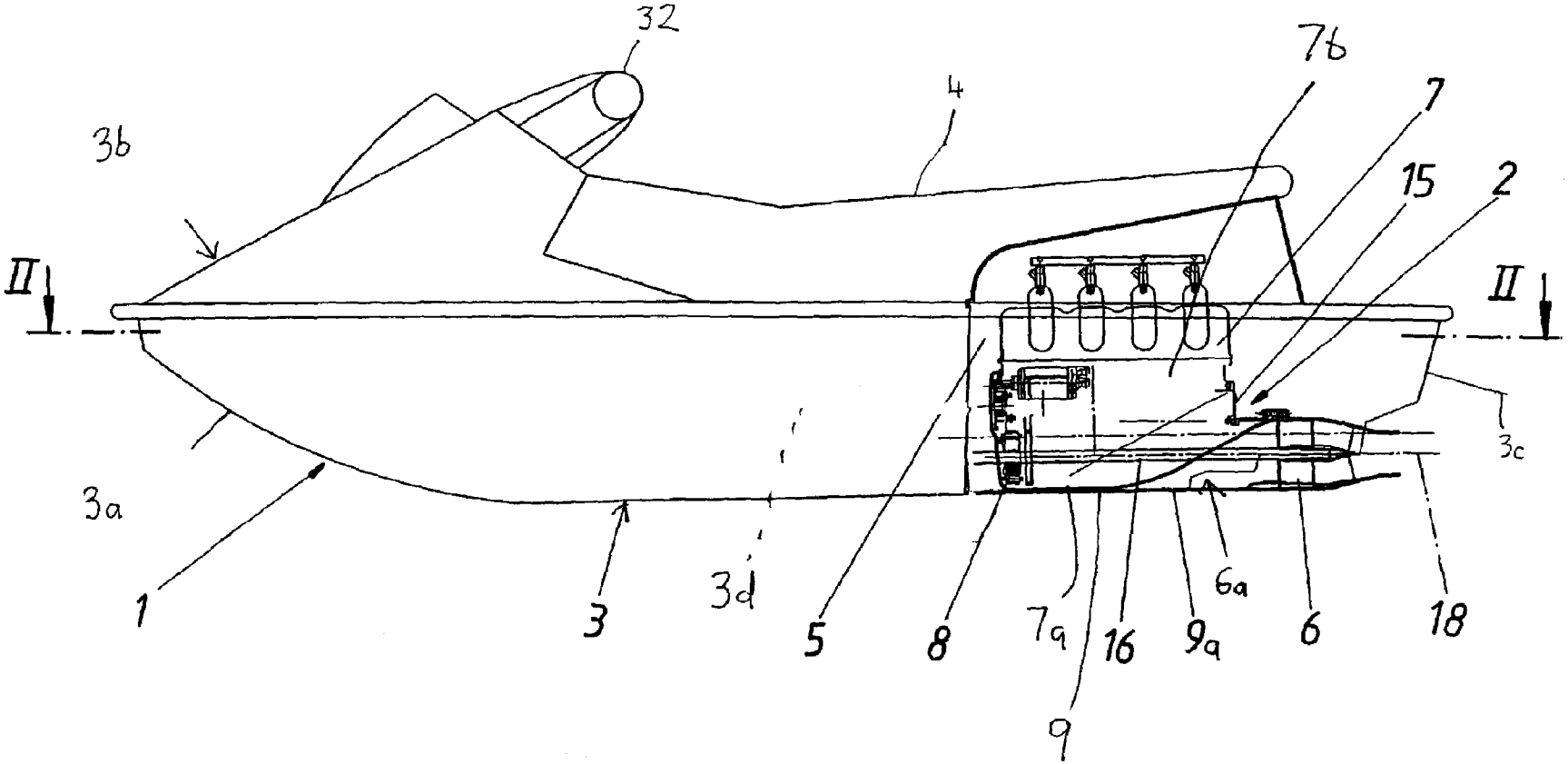
FIG. 1 is a left side view of a personal watercraft having a partial sectional view of an inboard propulsion system according to an embodiment of the present invention.

Referring now in detail to the Figures, a personal watercraft constructed in accordance with an embodiment of the invention is identified generally by the reference numeral 1. An example of the personal watercraft is disclosed in U.S. patent application Ser. No. 10/195,324, titled "Personal Watercraft Having Off-Power Steering System," the disclosure of which is incorporated specifically herein by reference. Although a specific configuration for the watercraft 1 will be described, it should be readily apparent to those skilled in the art that many facets of the invention are adaptable for use with watercraft types considerably different than that disclosed.

As shown in FIG. 1, the personal watercraft 1 comprises a shell 3 that includes a hull 3*a* and a deck 3*b*, which both may be formed from any suitable material such as a molded fiberglass resin or the like. The hull 3*a* and deck 3*b* are sealed along their common edge to form an enclosed dry interior 3*d* of the shell 3. The rearward end of the shell 3 defines a transom 3*c*. A driver and/or passenger riding on the watercraft 1 straddles a seat 4, which is mounted to or integrally formed with the shell 3. The driver steers the watercraft 1 using a steering input structure in the form of handlebars 32 located forwardly of the seat 4.

Figure 2:
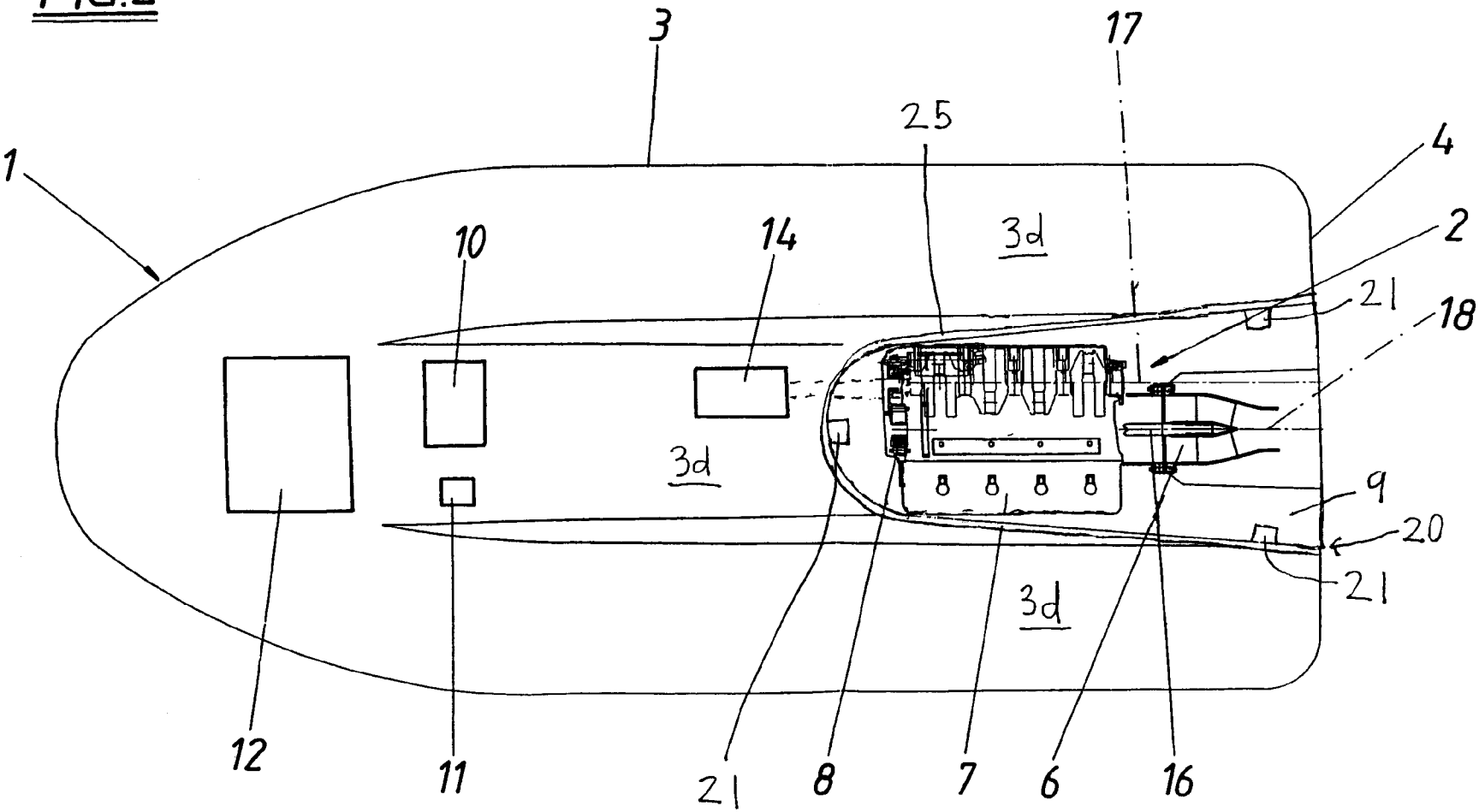
FIG. 2 is a top cross sectional view of the personal watercraft and the inboard propulsion unit of FIG. 1 along section line II—II.
Figure 3:
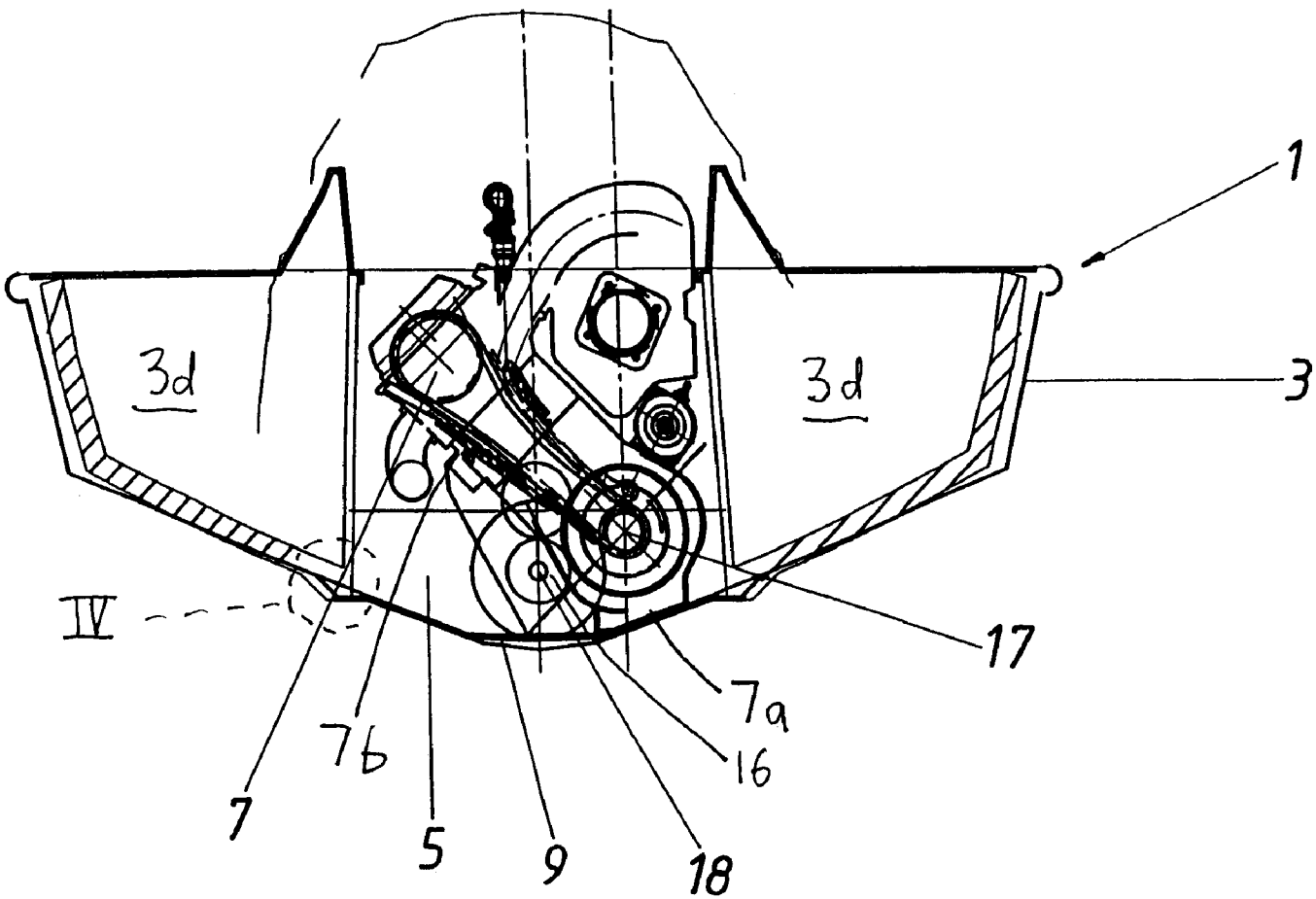
FIG. 3 is partial cross sectional end view of the personal watercraft illustrating the orientation of the inboard propulsion unit.

As shown in FIGS. 1–3, the watercraft 1 has a tunnel 5 that extends forwardly from the transom in the direction of the longitudinal axis of the watercraft 1 to a middle portion of the shell 3. The tunnel 5 can extend as far as the bow of the watercraft 1. The tunnel 5 is defined on its front and sides by the shell 3. The tunnel 5 is defined on its top by the shell 3 or the seat 4. Conversely, the bottom and rear end of the tunnel 5 are open. The tunnel 5 defines a "wet" volume or chamber that is not sealed within the shell 3.

As shown in FIG. 1, the watercraft 1 has an inboard propulsion system 2 that mounts to the shell 3 in the tunnel 5. The inboard propulsion system 2 comprises a jet pump 6 and an internal combustion engine 7. The jet pump 6 and engine 7 are connected by a linkage 8 including gearing and a clutch assembly to transmit power from the engine 7 to the jet pump 6. The engine 7 and the jet pump 6 mount to a ride plate 9. Alternatively, one or more parts of the engine 7 (e.g., engine block 7*b*, oil pan 7*a*, crankcase 15) and jet pump 6 (e.g., intake area 6*a*) may be integrally formed with the ride plate 9, without deviating from the scope of the present invention.

It is advantageous that the crankcase 15 of the engine 7 be integrally formed with the ride plate 9. Such integral formation provides improved support for the driveshaft 16 of the jet pump 6 so that the jet pump 6 can comprise lighter, less rugged materials. The additional support from the ride plate 9 and crankcase 15 can also eliminate the need for large bearings disposed between the jet pump 6 housing and the driveshaft 16, which tend to impede the flow of water through the jet pump 6 and reduce the power output of the jet pump 6.

Figure 4:
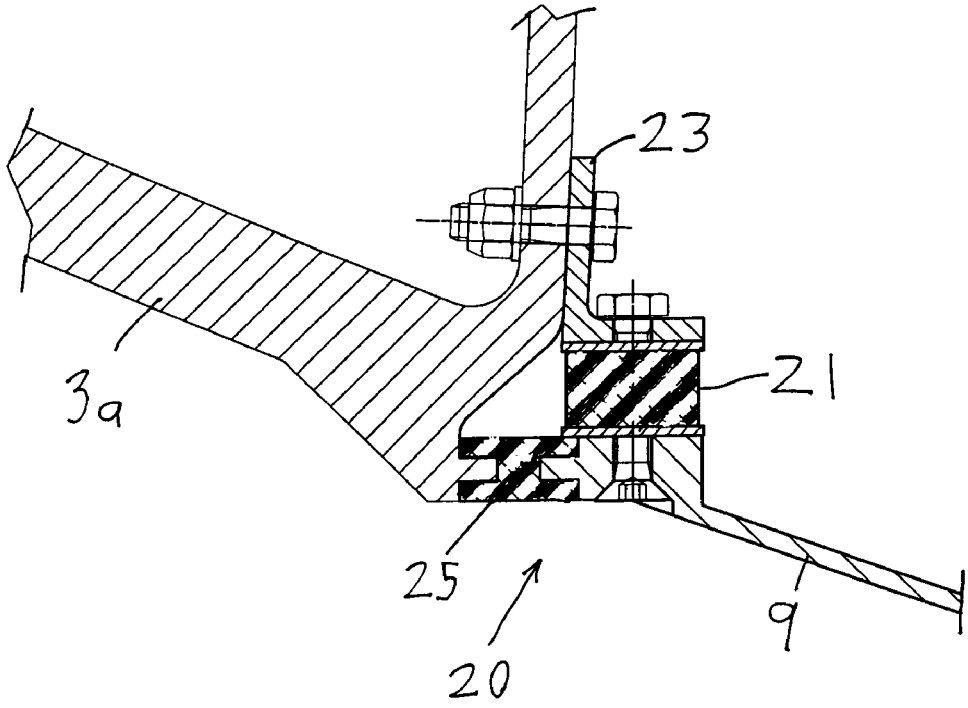
FIG. 4 is a detail view of a portion of the cross sectional view in FIG. 3.

As shown in the detail view in FIG. 4, the ride plate 9 mounts to the shell 3 via a flexible connection 20. The flexible connection 20 includes a plurality of damping elements 21 that extend between brackets 23 on the hull 3*a* and the ride plate 9. The brackets 23 are bolted to the hull 3*a*, but may be alternatively fastened to the hull 3*a* via screws, glue, integral formation, etc. Each damping element 21 bolts or otherwise fastens to the ride plate 9 and a corresponding bracket 23. Each damping element 21 comprises a resilient material such as rubber. As shown in FIG. 2, damping elements 21 are spaced around the intersection between the shell 3*a* and the ride plate 9. While three damping elements 21 are shown, greater or fewer damping elements 21 could alternatively be used.

As shown in FIGS. 2 and 4, the flexible connection 20 also includes an I-shaped rubber liner 25 that extends around a perimeter of the intersection between the ride plate 9 and the hull 3*a*. As shown in FIG. 4, the rubber liner 25 mates with protrusions on the hull 3*a* and ride plate 9. The rubber liner 25 prevents the ride plate 9 from rubbing against the hull 3*a*. Other configurations of the liner 25 are contemplated, which would prevent the ride plate 9 from rubbing against the hull 3*a*. The illustrated liner 25 comprises rubber, but may alternatively comprise any other suitable flexible material such as plastic. When the ride plate 9 and liner 25 are installed in the watercraft 1, the ride plate 9 forms a generally continuous surface with the underwater hull 3*a* of the watercraft 1 so that the watercraft 1 planes on the hull 3*a* and ride plate 9.

The damping elements 21 and liner 25 support the ride plate 9, engine 7, and jet pump 6 on the shell 3 and dampen vibrations generated by the engine 7 and jet pump 6. The damping elements 21 and liner 25 enable the ride plate 9 to float or shift slightly relative to the shell 3.

As shown in FIG. 2, the ride plate 9 tapers as it progresses forwardly so that the ride plate 9 wedges against the hull 3*a* through the liner 25. The wedging force ensures a tight fit between the ride plate 9, liner 25, and hull 3*a*. This tight fit discourages water from getting into the tunnel 5 at the intersection between the hull 3*a* and ride plate 9. The flexible connection 20 may be watertight, or may alternatively simply discourage water from splashing up into the engine 7 in the tunnel 5. The tunnel 5 may therefore be designed to be wet or dry. The ride plate 9 may alternatively have a constant width without deviating from the scope of the present invention.

Figure 5:
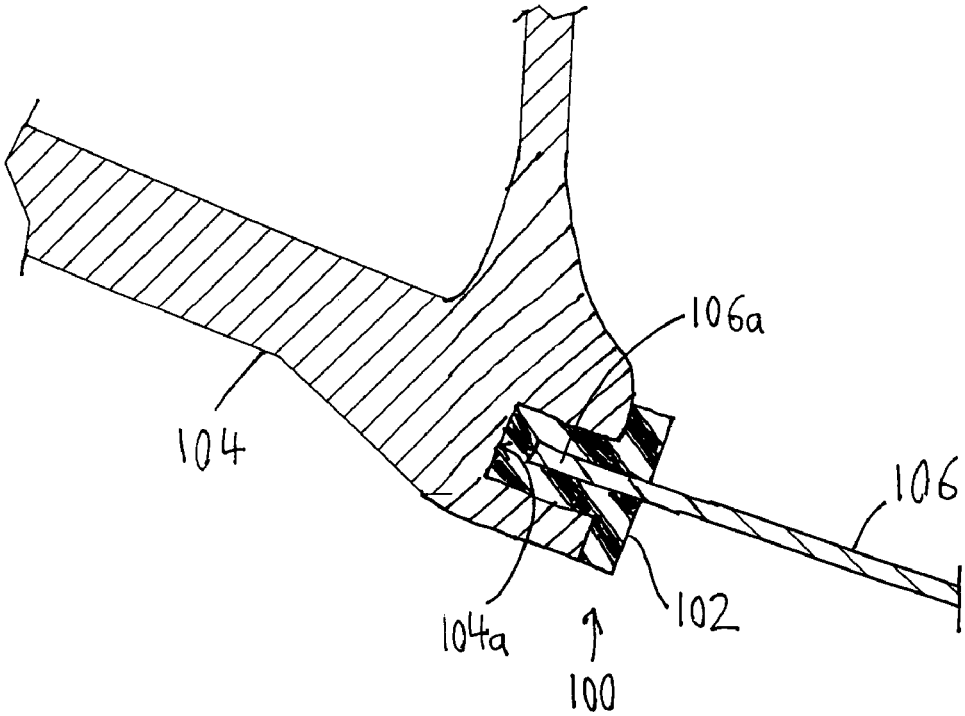
FIG. 5 is a detail view of a portion of the cross sectional view of FIG. 3, which illustrates a flexible connection according to an alternative embodiment of the present invention.

FIG. 5 illustrates a flexible connection 100 according to an alternative embodiment of the present invention. The flexible connection 100 may replace the flexible connection 20 illustrated in FIG. 4 This embodiment is otherwise similar to the previous embodiment. Accordingly a redundant description of similar features is omitted. In this embodiment, the flexible connection 100 comprises a U-shaped rubber liner 102 that is disposed between a hull 104 and a ride plate 106. The hull 104 and ride plate 106 are identical to the previously described hull 3*a* and ride plate 9 other than at the flexible connection 100. The hull 104 has a channel 104*a* that extends around the perimeter of the intersection between the hull 104 and ride plate 106. The illustrated channel 104*a* is integrally formed with the hull 104, but may alternatively be separately constructed and mounted to the hull 104. The portion of the hull 104 that surrounds the channel 104*a* may be reinforced to strengthen the connection 100. The liner 102 fits into the channel 104*a* and extends around the perimeter of the intersection between the hull 104 and ride plate 106. An outer edge 106*a* of the ride plate 106 fits into the U shape of the liner 102. The liner 102 therefore provides a flexible connection between the hull 104 and the ride plate 106 that dampens vibrations of the ride plate 106 and associated engine and jet pump. The flexible connection 100 may also include one or more damping elements 21 and brackets 23 to prevent the ride plate 106 from moving rearwardly relative to the hull 104. Alternatively, a laterally extending ridge or depression may be formed on the hull 104 and mate with a correspondingly shaped ridge or depression on the ride plate 106 to prevent the ride plate 106 from moving rearwardly. Alternatively, a movable transom that is mounted to the hull 104 may engage a rear edge of the ride plate 106 to prevent the ride plate 106 from moving rearwardly.

Returning to the embodiment illustrated in FIGS. 1–4, the ride plate 9, engine 7, and jet pump 6 are installed in the tunnel 5 either from below or from the rear. Mounting the propulsion system 2 in the tunnel 5 makes it simple to remove and install the engine 7 from outside the watercraft 1, which simplifies engine 7 maintenance. Similarly, the complete propulsion system 2 can be replaced in a very short time.

As shown in FIG. 2, a battery 10, engine electronics 11, and a fuel tank 12 are arranged within the interior 3*d* of the shell 3 and connected to the engine 7 via connector lines (not shown). An airbox 14 is also mounted in the interior 3*d* of the shell 3, and is connected to an engine 7 induction tube through an air duct. Positioning these elements in the shell 3 protects them from water and spray. Positioning the airbox 14 in the shell 3 ensures that the engine 7 does not aspirate water and ensures that the air that is aspirated is at the lowest possible temperature, which increases engine 7 power. To appropriately distribute weight on the shell 3, the battery 10, electronics 11, and fuel tank 12 are disposed in a forward portion of the interior 3*d* of the shell 3, which balances the weight of the rearwardly disposed jet propulsion system 2.

As shown in FIG. 1, an intake area 6*a* of the jet pump 6, a crankcase 15 of the engine 7, and the ride plate 9 form a structural unit around which water flows. As shown in FIGS. 1 and 3, an oil pan 7*a* of the engine 7 is arranged directly on the ride plate 9. Alternatively, the oil pan 7*a* or any other suitable part of the engine 7 may be integrally formed with the ride plate 9. The constant flow of water around the ride plate 9 cools the oil pan 7*a* and engine oil. An engine block 7*b* of the engine 7 is cooled in the usual way, either by a water pump and through a filter, directly from the water, or by tapping off water from the jet pump 6, as is known from the prior art. Alternatively, heat transfer from the engine block 7*b* through the ride plate 9 into the water may be sufficient enough that additional engine cooling is not needed. The engine 7 is therefore effectively cooled.

The propulsion system 2 therefore combines the advantages of inboard engines known from the prior art with those of known outboard engines, without the need to accept the disadvantages inherent in these. Since the propulsion system 2 is installed within the watercraft 1, and is surrounded by the shell 3 of the watercraft 1, the watercraft 1 can be operated with very little noise, without the need for major noise-attenuating measures. In order to reduce the amount of noise that is emitted, the tunnel must simply be closed off to the rear by a cover or the like that can be opened. Since the engine 7 mounts directly on the ride plate 9 and is thermally exposed, at least partially, to water flowing past it, there is no danger of excessive heating of the engine 7. A double-walled exhaust system is no longer needed because it is sufficient to use stainless-steel manifolds that route the exhaust gases into the water either directly or by way of a muffler.

As shown in FIG. 1, the driveshaft 16 for the jet pump 6 is supported axially within the crankcase 15. As shown in FIG. 3, the engine 7 is inclined about its longitudinal axis above the jet pump 6 to achieve the most compact possible construction. As shown in FIG. 3, the engine 7 is disposed at an angle with respect to the vertical axis. Accordingly, a crankshaft 17 of the engine 7 is laterally adjacent to the driveshaft 16 (i.e., the crankshaft 17 and driveshaft 16 occupy overlapping longitudinal positions on the watercraft 1). An axis 18 of the driveshaft 16 and an axis of the crankshaft 17 are parallel. The engine 7 is preferably an in-line engine to minimize its size. The engine 7 may be a two-stroke or four-stroke engine and may have one, two, or more cylinders.

The jet pump 6 includes an impeller connected to the driveshaft 16 for rotational driving by the engine 7. As the engine 7 rotates the impeller, the blades of the impeller draw water into the jet pump 6 via an intake opening 9*a* in the ride plate 9 and an intake area 6*a* of the jet pump 6. Water is then expelled from the jet pump 6 in a pressurized stream through a discharge opening to propel the watercraft 1. A steering nozzle adjacent to and in fluid communication with the discharge opening is supported for pivotal movement about a generally vertically extending axis. An example of the steering nozzle is disclosed in U.S. patent application Ser. No. 10/195,324, titled "Personal Watercraft Having Off-Power Steering System," the disclosure of which is incorporated specifically herein by reference. The pressurized stream of water discharged from the discharge opening flows through the nozzle. As a result, pivoting the nozzle about its generally vertically extending axis changes the direction of the pressurized water stream with respect to the longitudinal axis of the watercraft, and thus steers the watercraft 1. The handlebars 32 are interconnected to this steering nozzle by a typical mechanical linkage or any other suitable mechanism such that manual movement of the handlebars 32 pivotally moves the nozzle as desired by the user to affect steering.

While the invention has been described in connection with what is presently considered to be the most practical and preferred embodiments, it is to be understood that the invention is not to be limited to the disclosed embodiments and elements, but, to the contrary, is intended to cover various modifications, equivalent arrangements, and equivalent elements included within the spirit and scope of the appended claims.

What is claimed is:

1. A personal watercraft comprising:

a hull defining an underwater surface of the personal watercraft;

a deck disposed on the hull;

a straddle seat disposed on the deck;

handlebars mounted on the deck forward of the seat for steering the personal watercraft;

a ride plate mounted to the bottom of the hull;

an internal combustion engine supported by the ride plate; and a jet pump operatively connected to the internal combustion engine and supported by the ride plate, the ride plate having a first side and a second side opposite to the first side, the first side of the ride plate forming part of the underwater surface of the personal watercraft and the internal combustion engine being mounted to the second side of the ride plate in thermal communication therewith.

2. The personal watercraft of claim 1, wherein the jet pump is mounted to the second side of the ride plate.

3. The personal watercraft of claim 1, wherein the internal combustion engine comprises a crankcase that is integrally formed with the ride plate.

4. The personal watercraft of claim 3, wherein the internal combustion engine comprises an engine oil pan mounted to the ride plate.

5. The personal watercraft of claim 1, further comprising an elastomeric material disposed between the hull and the ride plate.

6. The personal watercraft of claim 5, wherein the elastomeric material is a flexible rubber seal.

7. The personal watercraft of claim 2, further comprising an elastomeric material disposed between the hull and the ride plate.

8. The personal watercraft of claim 1, further comprising:

a transom being defined by the hull;

a first compartment being defined between the hull and the deck, and a tunnel extending forwardly from the transom, the tunnel being defined laterally by the hull, the tunnel having an open bottom, the ride plate being mounted to the hull at the bottom of the tunnel, the tunnel and the ride plate defining a second compartment, and the internal combustion engine and the jet pump being disposed in the second compartment.

9. The personal watercraft of claim 8, wherein the hull defines a top of the tunnel.

10. The personal watercraft of claim 8, further comprising one of a battery, engine electronics, an air box, and a fuel tank disposed in the first compartment, the one of a battery, engine electronics, air box and a fuel tank being operatively connected to the engine.

11. The personal watercraft of claim 10, wherein the first compartment is sealed off from the second compartment.

* * * * *